United States Patent [19]

Khazzam

[11] 4,046,377

[45] Sept. 6, 1977

[54] TENNIS RACQUET

[75] Inventor: Joseph N. Khazzam, Baldwin, N.Y.

[73] Assignee: Regent Sports Corporation, Hauppauge, N.Y.

[21] Appl. No.: 442,369

[22] Filed: Feb. 14, 1974

[51] Int. Cl.[2] ..... A63B 49/02

[52] U.S. Cl. ..... 273/73 G

[58] Field of Search ..... 273/73 R, 73 C, 73 D, 273/73 G, 73 H

[56] References Cited

U.S. PATENT DOCUMENTS

| | | | |
|---|---|---|---|
| 1,100,244 | 6/1914 | Johnson | 273/73 G |
| 1,452,803 | 4/1923 | Harris | 273/73 H |
| 1,524,826 | 2/1925 | Icke et al. | 273/73 H |
| 1,618,727 | 2/1927 | Reach | 273/73 H |
| 2,171,223 | 8/1939 | Robinson | 273/73 H |
| 2,456,023 | 12/1948 | Rosenbalm | 273/73 D |
| 3,612,526 | 10/1971 | Brull | 273/73 G X |
| 3,702,701 | 11/1972 | Vaughn et al. | 273/73 G X |

FOREIGN PATENT DOCUMENTS

| | | | |
|---|---|---|---|
| 2,010,450 | 9/1971 | Germany | 273/73 G |
| 252,480 | 6/1926 | United Kingdom | 273/73 H |

*Primary Examiner*—Richard J. Apley
*Attorney, Agent, or Firm*—William R. Liberman

[57] ABSTRACT

A preformed bridge element has concave curved sides to embrace the inner aspects of a metal racquet frame, and has a locating pin extending laterally from each side to engage openings in the frame sides, the stringing eyes extending upwardly from the top of the bridge bar being defined by a sinuous element, the ends of which are secured to the locating pin.

3 Claims, 4 Drawing Figures

TENNIS RACQUET

BACKGROUND OF THE INVENTION

The invention relates generally to stringed racquets used in the playing of such games as tennis, badminton, squash, paddle ball, and the like. In particular, the present invention relates to racquets of metal, to the securement of the handle thereto, and to the stringing thereof.

Racquets of metal are strung in manner like to that of wooden racquets, but since the metal is not normally as yieldable as wood, care must be taken to protect the material of which the stringing is formed against abrasion and untoward wear.

Metal racquets usually are formed of elongated strips of material bent into inverted U-shape, the trough or bight of the U-shape being spread to define a generally oval-shaped stringed area, the ends of the strips being brought around towards each other to embrace a handle element or to form part of the handle assembly. The overall length of the racquet is about 27 inches, the width of the oval varying between 9 inches to 10 inches, the length exceeding that by an inch or two. The problem has arisen in the stringing of the generally oval-shaped striking area at or about the immediate area whereat the ends of the metal frame are bent inwardly and extend into or form — at least in part — the handle. The area where the oval merges into the handle is commonly referred to as the throat, and will be so referred to hereinbelow. Manifestly, it is not practical to bring together and into contact the metal lengths at the point where the stringed area ends and the handle begins, the bend of the metal would necessarily be too abrupt and destructive of the frame. One expedient used in solving the problem is shown in one prior art racquet wherein an element bridging the throat is welded to and between the sides of the frame at the throat area, closely adjacent the curve extending from the striking area to the handle. The welding, however, makes for considerable additional expense, not only for the labor involved in that step, but also because the metal must then be refinished to hide or cover the unsightly and metal-discoloring weld joints. It is thus highly desirable to avoid welding or other expensive and cost-increasing operations. Another prior art patent presents another type of bridging element, the flattened ends of which float within elongated slots in the facing sides of the frame, but this, too, is ineffective except in providing means for anchoring or threading the vertical strands of the stringing in the center of the oval.

SUMMARY OF THE INVENTION

Considering then the shortcomings of prior practices, actual and theoretical, it is a principal object of the present invention to provide a metal bridging element at the throat area of a metal racquet which can be inserted easily and quickly, without the use of special tools, and which will serve to retain the frame sides against relative movement.

Another object is to provide a unitary bridging element which incorporates means to restrain the racquet sides against relative movement towards and away from each other.

Still another object is to provide, in a bridging member, eyes or loops through which certain of the vertical stringing can be threaded, the eyes or loops being immovably held in a bridging member and anchored to the means which restrain the frame sides against spreading movement.

A still further object of the present invention is to provide a bridge member with means to secure same in the frame throat against any longitudinal or transverse movement.

These objects are attained by moulding or casting a bridge member of plastic material having embedded therein, and extending laterally therefrom, a metal cross bar which engages openings in the inner walls of the hollow metal racquet frame, the bridge member being of generally trapezoidal shape and having curved concave side walls to embrace the inner convex walls of the frame, and having also embedded within the bridge a sinuous metal element with laterally spaced inverted U-shaped loops projecting upwardly from the upper border of the bridge, with the ends of the element being secured to the cross bar.

BRIEF DESCRIPTION OF THE DRAWING

In the annexed drawing.

DESCRIPTION OF THE PREFERRED EMBODIMENT

Figure 1:
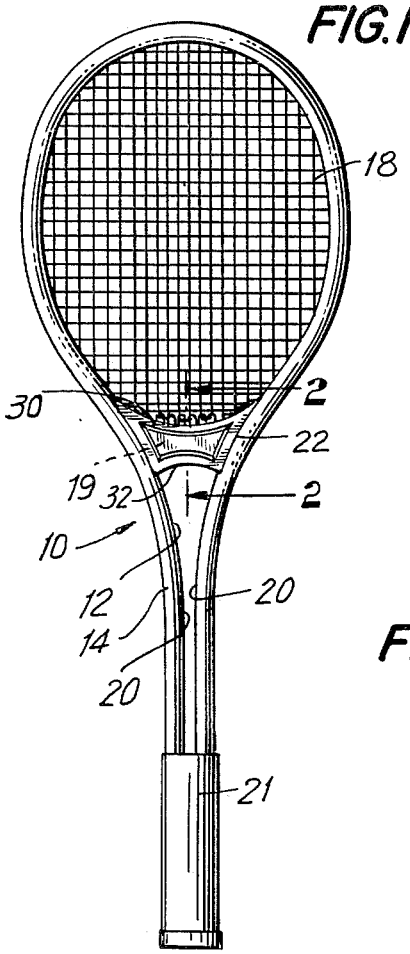
FIG. 1 is a front elevational view of one form of strung metal racquet constructed according to and embodying the present invention.
Figure 2:
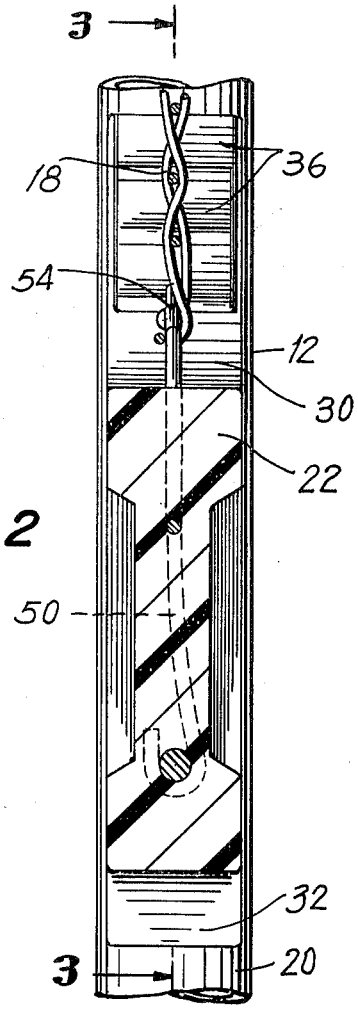
FIG. 2 is a vertical section, enlarged, on the line 2—2 of FIG. 1.
Figure 4:
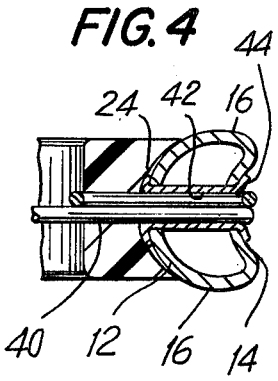
FIG. 4 is a section on line 4—4 of FIG. 3.

The racquet frame 10, about 27+ inches in overall length, is formed of a suitable extrudable metal such as aluminum, magnesium, graphite, or the like. The extrusion is hollow to reduce weight, and may initially be circular and then deformed, or it may — as shown — be initially extruded so that it is convexly rounded along one face 12, and concave along the opposite face 14, the opposing being joined by curving end walls 16, 16, shaped roughly as a banana. The wall section of the extrusion is about 1/32 inch thick, and its longest dimension is slightly longer than ½ inch, while its transverse dimension, centrally thereof, is about 10/32 inch. For convenience of reference, the concave side of the frame will be referred to as the outer face thereof, and the convex side as the inner face. The extrustion, of suitable length, is bent into the conventional racquet shape; that is, into a generally oval-shaped striking area 18, with the free ends 20, 20 being curved inwardly and into parallelism to provide a handle member as at 21. It will be seen that oval 18 is necessarily incomplete at the lower end thereof, the throat portion 19, and a bridge member 22 is provided to extend across the throat opening and close off the throat opening and to complete the oval wherein the stringing is threaded.

In accordance with the present invention, bridge 22 is moulded in one piece, and has several purposes. It defines and maintains the exact lateral spacing desired between sides 12, doing so by means of concaved outer faces 24 which are curved on substantially the same degree of curvature as the convex inner faces of the frame so as to closely embrace the frame sides as at 24. Consequently, and since the bridge member 22 is of material which resists compression, the frame sides embraced by bridge 22 will be kept apart the exact distance desired. Bridge 22 also serves to locate and anchor the stringing eyes for the threading of the vertical strands of the racquet striking area. Finally, means as 46 are provided as an integral part of bridge member 22 to prevent the strung racquet from losing the tension of the string area upon striking the ball or other game element, and also to prevent the racquet sides from spreading from the relative predetermined spacing between the sides.

Figure 3:
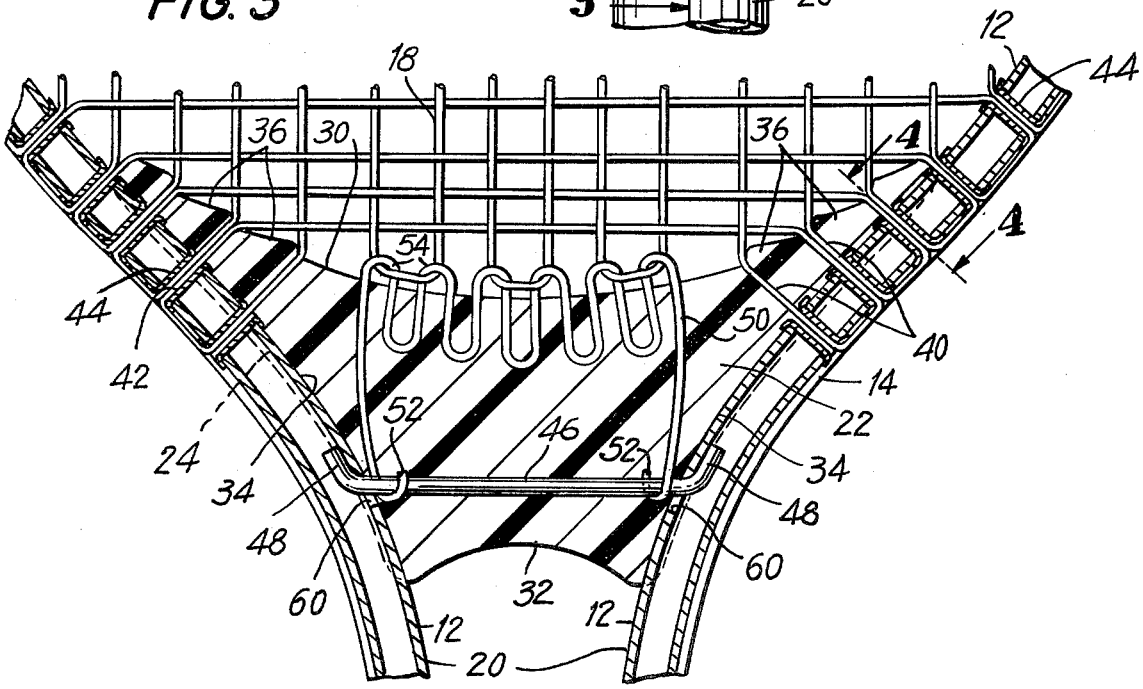
FIG. 3 is a vertical section, enlarged, on the line 3—3 of FIG. 2.

Bridge 22 is formed, as by moulding or casting, of any suitable thermoplastic resin material, as nylon or Cycolac, an ABS polymer product of the Marlon Division of Borg-Warner Corp. The bridge is generally trapezoidal in shape, although the wider top edge 30 is about 5 ½ inches long from side to side, is downwardly curved, and the sides 34, 34, about 3 ¾ inches long, are slightly inwardly concaved on an arc from the top to the bottom edges. The bridge is about ½ inches in thickness along the margins thereof and may be thinned in the center to reduce weight. The top edge 30 of the bridge 22 is stepped along each end thereof as at 36, 36, with stringing openings 40 extending through the ends of the bridge openings 40 angled upwardly and inwardly as seen in FIG. 3. Openings 40, it will be appreciated, are so spaced that they live up with corresponding openings 42 in the frame, each frame opening 42 having a hollow tubular rivet or eyelet 44, the open ends of which rivet or eyelet are rounded, thereby to reduce friction and wear on the stringing passing through the frame openings when the racquet is in use.

Embedded within the body of bridge 22 and below the middle thereof is a circular-section cross-bar 46 of hardened stainless steel or other suitable metallic material, about ⅜ inch thick, ends 48 of which, of ⅝ inch in length, extend outwardly of the bridge side walls 34, 34, and are angled upwardly and outwardly to substantially 120° from the horizontal, the reasons for which will be amplified hereinbelow. Also embedded within the body of bridge 22 and secured to cross-bar 46 is a hardened stainless steel wire or thin rod 50, the ends 52 of which are hooked around cross-bar 46 closely adjacent the ends thereof. The middle portion of wire 50 extends above the top 30 of bridge 22, in the center thereof, and is bent back and forth on itself to define a plurality of loops or eyes 54, portions of which extend above the bridge top 30, while the portion of the wire joining eyes 54 is contained within the block forming the bridge 22.

It will be seen that laterally spaced openings similar to 42 are formed through frame 12 all around the throat area, receiving the bridge from one side to the other, each margined by a corresponding rivet or eyelet. The stringing with gut or metallic stranding is accomplished in the usual manner by threading the material under tension horizontally and vertically across the sriking area with the closed oval defined by frame sides and top of bridge 22.

Below the lowermost of the stringing openings in the frame sides 12, these extending entirely through the frame, I provide a pair of openings 60,60, which are formed only through the inner sides 20, 20 of the frame sides, and are about 3/16 inch in diameter. After the frame has been bent into the desired oval shape on a suitable mandrel with the ends brought towards and into parallelism, one hooked end 48 of the bridge cross-bar 46 is threaded into a corresponding opening 60, the other frame side can then be manipulated easily, since the racquet has not yet been strung, to bring the free end of the other hooked end 48 into line with and into the other opening 60 so that the ends 48, 48 extend upwardly into and within the hollow frame, and closely along the inner surface of the inside face of the frame legs. Such arrangement, after the racquet has been strung, will lock the racquet parts together. Thus, the sides of the frame, embraced by the curved sides of the bridge, will be prevented from moving towards each other, while the fingers 48, interfitting with the frame sides, will prevent the sides from moving further apart from each other, and the bridge from moving upwardly, even under the strains imposed by impact of the stringing against a ball or other playing device.

I claim:

1. A strung racquet frame of elongated hollow tubing comprising a strung head portion, a throat portion, and a handle portion, the space between the frame sides at the throat portion being closed by a generally trapezoidal bridge member which is embraced by the frame sides and engaged by the frame stringing, a cross-bar embedded within and extending laterally of the bridge member, said cross-bar having arms extending outwardly therefrom, into, within, and only upwardly along the inner aspect of the hollow tubing, the bridge member and the interengagement of the cross-bar component thereof with the frame throat restraining the frame sides against lateral movements towards and away from each other, the bridge member and cross-bar being otherwise unsecured to the frame, and the stringing through the frame and the bridge member uring the bridge member upwardly and the embedded cross-bar and arms into more positive engagement with the frame sides.

2. A racquet frame as in claim 1, wherein the arms extending from the cross-bar embedded within the bridge, have free end portions of substantially one-half inch in length extending beyond the bridge body and upwardly at an obtuse angle therefrom, and said end portions extend upwardly into the hollow tubing and interengage with the frame sides, thereby to maintain the bridge member within the frame in the absence of other securement.

3. A strung racquet frame as in claim 1, wherein the cross-bar is generally U-shaped, the base being embedded within the bridge, and the arms extending upwardly and outwardly therefrom at an angle obtuse with respect to the base, whereby to maintain the bridge between the frame sides at the throat in the absence of other securement.

* * * * *